US006122933A

United States Patent [19]

Ohlund

[11] Patent Number: 6,122,933

[45] Date of Patent: Sep. 26, 2000

[54] JEWELRY PIECE

[76] Inventor: Stephen K. Ohlund, 1533 Osos St., San Luis Obispo, Calif. 93401

[21] Appl. No.: 09/134,189

[22] Filed: Aug. 14, 1998

[51] Int. Cl.[7] ..... A44C 5/00; F21V 21/08

[52] U.S. Cl. ..... 63/3; 63/3.1; 362/104; 429/97; 439/805

[58] Field of Search ..... 63/2 L, 3, 3.1, 63/33, FOR 101; 362/104, 340; 429/97; 439/500, 805

[56] References Cited

U.S. PATENT DOCUMENTS

| | | | |
|---|---|---|---|
| 476,080 | 5/1892 | Sanche | 439/794 |
| 1,771,710 | 7/1930 | Gover | 40/540 |
| 1,951,259 | 3/1934 | Ryalls | 439/726 |
| 2,056,248 | 10/1936 | Buchanan | 439/784 |
| 2,615,227 | 10/1952 | Hornik | 24/303 |
| 2,931,009 | 3/1960 | Dutton et al. | 439/805 |
| 3,254,323 | 5/1966 | Wyse | 439/457 |
| 3,829,332 | 8/1974 | Iizuka et al. | 429/97 |
| 4,262,324 | 4/1981 | Murphy | 362/104 |
| 4,271,457 | 6/1981 | Martin | 362/104 |
| 4,296,459 | 10/1981 | DeLuca | 362/104 |
| 4,309,743 | 1/1982 | Martin | 362/104 |
| 4,459,645 | 7/1984 | Glatter | 362/104 |
| 4,894,757 | 1/1990 | Frusha et al. | 362/104 |
| 5,367,891 | 11/1994 | Furuyama | 63/29.2 |
| 5,477,433 | 12/1995 | Ohlund | 362/104 |
| 5,622,062 | 4/1997 | Gong-Hwa | 63/15 |
| 5,653,530 | 8/1997 | Pittman | 362/307 |
| 5,690,412 | 11/1997 | Sheldon | 362/104 |
| 5,876,109 | 3/1999 | Scalco | 362/104 |

FOREIGN PATENT DOCUMENTS

| | | | |
|---|---|---|---|
| 35379 | 3/1930 | France | 439/805 |
| 2827886 | 1/1980 | Germany | 362/104 |

*Primary Examiner*—Terry Lee Melius
*Assistant Examiner*—Andrea Chop
*Attorney, Agent, or Firm*—John J. Connors; Connors & Assoc.

[57] ABSTRACT

A jewelry piece 10 includes a light transparent, ornamental element 20 and a light emitting diode 16 positioned near the ornamental element. A battery case 12 has a side wall 12*b* having a threaded opening 29 therein providing access to a battery being held within the battery case. A clasp 14 has an outwardly projecting threaded element 14*b* adapted to be received in the threaded opening 29. There is a first conductive wire 26 having one end connected to one terminal of the battery and another end connected to the diode 16 and a second conductive wire 30 having one end connected to the light source and another end having a clasp 14. The clasp 14, when partially inserted into the opening 29, completes a loop but does not contact the other terminal of the battery, preventing the diode 16 from being energized. When completely inserted into the opening 29, the clasp 14 makes contact with the other terminal of battery to energize the light source.

10 Claims, 4 Drawing Sheets

10
1b
2a
12
26a
14
1b
30
2a
26
1c
33

30
31
14
26b
4
4

21
12b
22
3
3
20
26
12a

JEWELRY PIECE

BACKGROUND OF THE INVENTION

1. Field of the Invention

This invention relates to an illuminated jewelry piece and, in particular, one which the wearer may, by adjusting a clasp, turn the illumination on and off without disconnecting the clasp.

2. Background Discussion

Illuminated jewelry pieces are well known and the inventor has described such an illuminated jewelry piece in his U.S. Pat. No. 5,477,433. As disclosed on this patent, the jewelry piece is illuminated intermittently. It would be desirable to provide an inexpensive, lightweight jewelry piece that allows the wearer to connect and disconnect the jewelry piece, and while connected, by simple movement of a clasp, cause the piece to be illuminated or have the illumination discontinued without completely disconnecting the clasp and removing the jewelry piece. This is especially desirable when the jewelry piece is a pendant or necklace.

SUMMARY OF THE INVENTION

It is the objective of this invention to provide a light weight, illuminated jewelry piece which by adjusting a clasp, turns the illumination on and off without disconnecting the clasp.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include, but are not limited to, an inexpensive to manufacture jewelry piece which is easy to use that may be illuminated or the illumination discontinued without detaching the jewelry piece by simply rotating a clasp.

The first feature of the jewelry piece of this invention is that it includes a light transparent, ornamental element positioned near a light source, such as a light emitting diode having a pair of electrodes. The light source is connected in a circuit powered by a battery (an assembly of a number of batteries is considered a single battery since the assembly acts as one unit), having first and second terminals, one positive the other negative as is conventional. The battery is retained in a case which has an opening therein providing access to the first terminal of the battery. Preferably, the battery case is adapted to removably hold the battery, and this battery case has a threaded opening therein. Preferably, the light source is seated in an opaque housing. This housing has only a single light transmitting window which allows light from the light source to be transmitted outward.

The second feature is a pair of flexible, conductive wires which electrically connects the light source to the battery in the case. A first conductive wire has one end connected to the second terminal of the battery and another end connected to the light source, and a second conductive wire has one end connected to the light source and another end having a clasp thereon, which is the third feature of this invention.

When partially inserted into the opening in the case, the clasp completes a loop around, for example, the neck of the wearer but does not contact the first terminal of the battery, preventing the light source from being energized. When completely inserted into the opening, the clasp makes contact with the first terminal of the battery to energize the light source. The second wire terminates in a conductive pin which passes through a passageway in the clasp, so that the clasp may be manually rotated relative to the pin and second wire. The clasp has a body with a threaded open end, a passageway extending through the body between the threaded end and another end. It is this threaded, open end of the clasp which is adapted to be received in the threaded opening in the battery case. When the clasp is so threaded into this threaded opening, the pin makes contact with the battery to complete a circuit and energize the light source.

DESCRIPTION OF THE DRAWING

The preferred embodiment of this invention, illustrating all its features, will now be discussed in detail. This embodiment depicts the novel and non-obvious jewelry piece of this invention as shown in the accompanying drawing, which is for illustrative purposes only. This drawing includes the following figures (FIGS.), with like numerals indicating like parts.

DETAILED DESCRIPTION OF THE PREFERRED EMBODIMENT

Figures 1A, 1B, 1C:
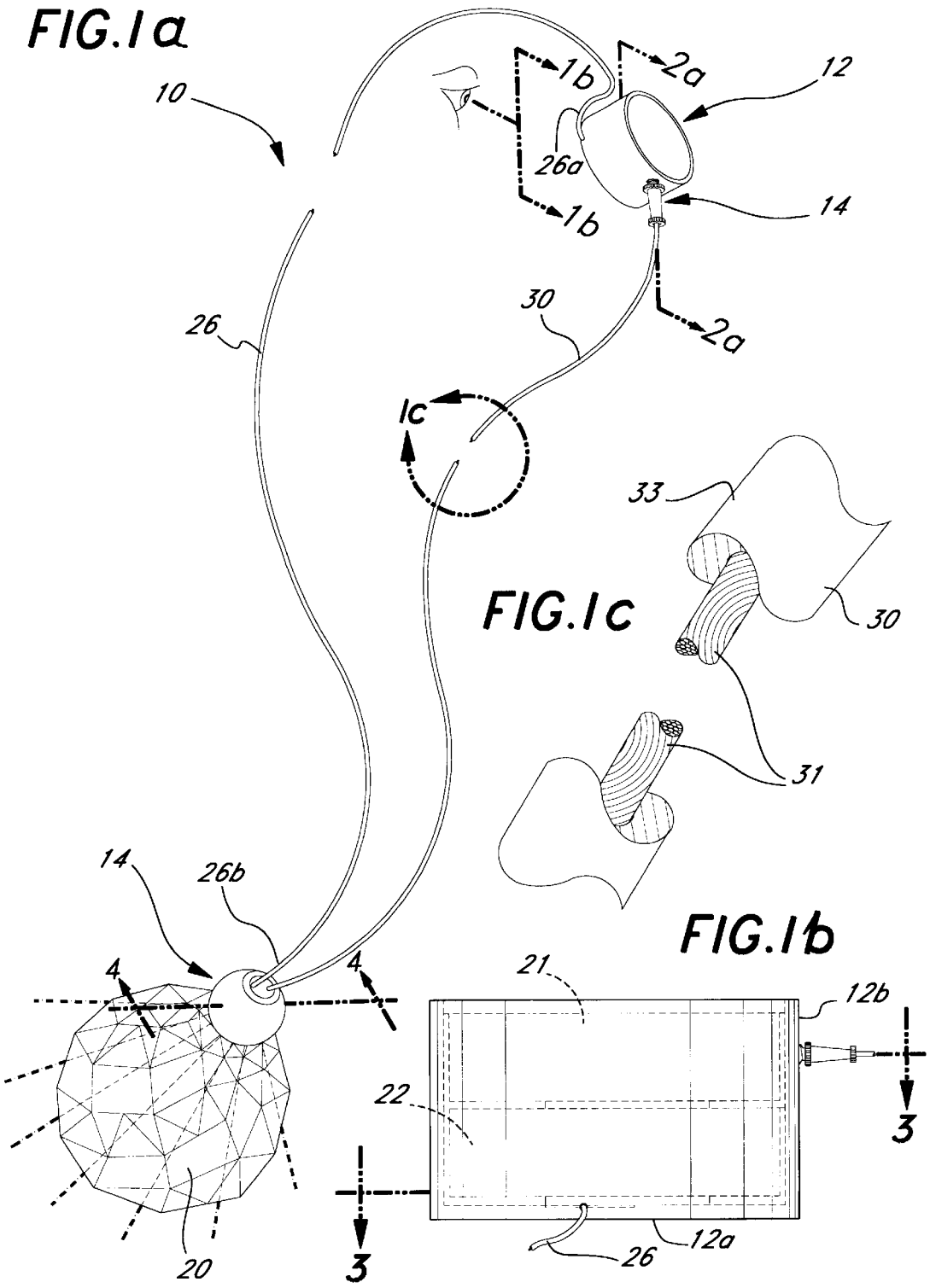
FIG. 1*a* is a perspective view of the jewelry piece of this invention.
FIG. 1*b* is a side elevational view of the battery case for the jewelry piece taken along line 1*b*—1*b* of FIG. 1.
FIG. 1*c* is an enlarged fragmentary view of a portion of one of the two wires connecting a battery to a light source in the jewelry piece of this invention.

The jewelry piece 10 of this invention includes a battery case 12, a metallic barrel clasp 14, a light emitting diode 16 (FIG. 4) as the light source, a housing 18 in which the diode is seated, and a transparent ornamental crystal 20 connected to the housing. A suitable light emitting diode 16 is made by Nichia Corporation of Japan.

Figure 1D:
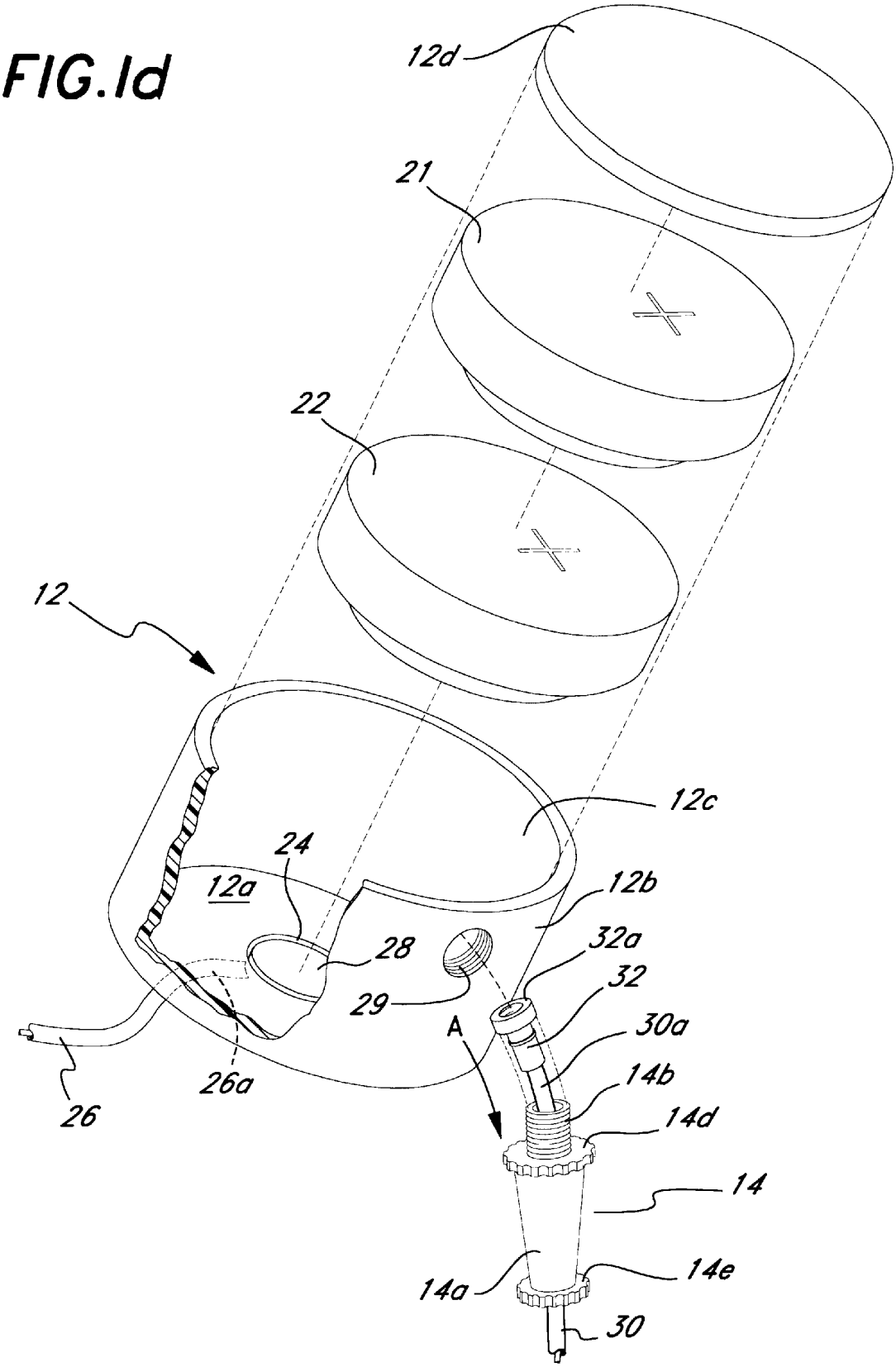
FIG. 1*d* is an exploded perspective view showing batteries being placed in the battery case.

As best shown in FIG. 1*d*, the battery case 12 is a hollow cylindrical element made from a plastic material using conventional injection molding techniques. It has a floor 12*a*, sidewall 12*b*, and an open top 12*c* in which is seated a cover 12*d* that is force fitted into the open top to snap in position to retain a pair of batteries 21 and 22 (3 volt lithium disk type) which fit snugly inside of the case 12. There is a threaded opening 29 in the sidewall 12*b*. In the floor 12*a* of the case 12 is an opening 24 through which extends one end 26*a* of a flexible wire 26. This one end 26*a* has a conductive element 28 which makes electrical contact with, in this case, the negative terminal 22*a* of the battery 22 seated in the case. This conductive element 28 may be flattened solder. The other end 26*b* of the flexible wire 26 is connected to one electrode 16*a* of the light emitting diode 16. A second wire 30 is connected to the other electrode 16*b* of the light emitting diode 16. Both the wires 26 and 30 are flexible and comprises strands 31 of conductive material such as copper covered with an insulating sheath 33, as depicted in FIG. 1*c*.

As best shown in FIG. 1*d*, and FIGS. 2*a* through 2*c*, the clasp 14 has a tubular type body 14*a* with a threaded extension 14*b* projecting outward from one end of the clasp which is inserted into the opening 29 in the sidewall 12*b* of the case 12 when attaching the jewelry piece 10 around, for example, the neck of a wearer. Thus, by inserting the threaded extension 14*b* into the opening 29 in the sidewall 12*b* and rotating in a clockwise as viewed in FIG. 1*a*, the jewelry piece 10 is attached to, for example, a wearer's neck. The tubular body 14*a* provides an elongated passageway 14*c* which extends through the entire body, including the threaded extension 14*b*. There are a pair of spaced apart, raised, knurled rings 14*d* and 14*e* on the exterior of the body 14*a* which assist in rotating the clasp 14 when attaching and detaching it around the wearer's neck.

Figure 2A:
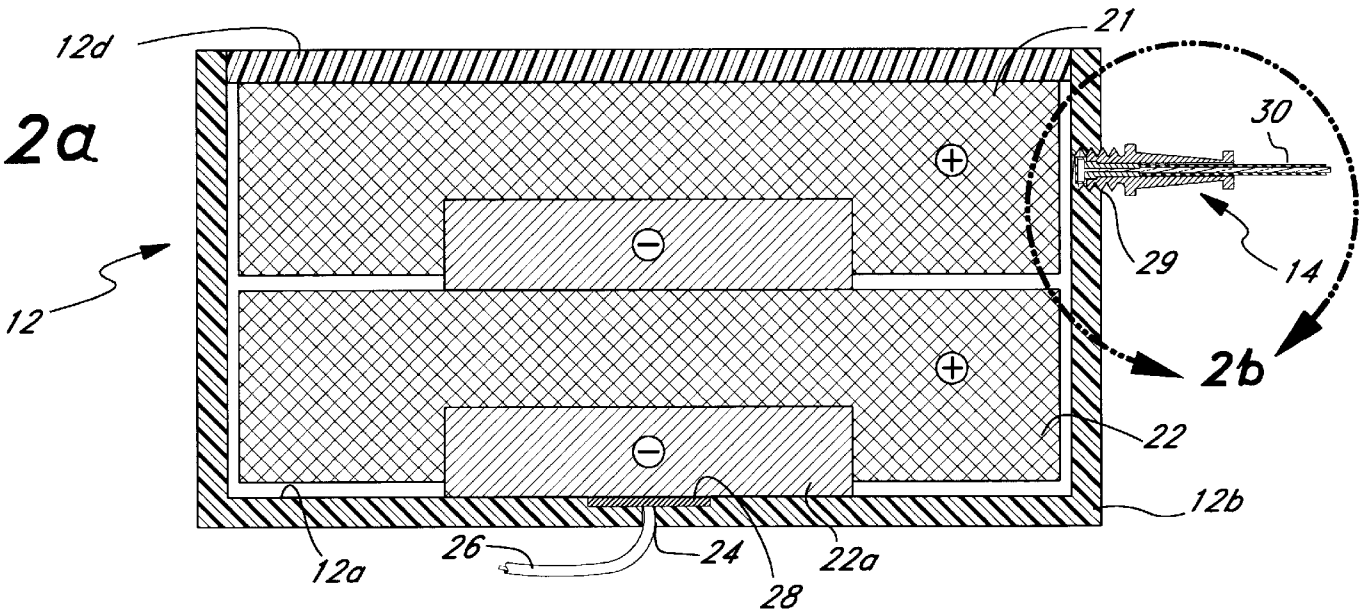
FIG. 2*a* is a cross-sectional view of the battery case taken along line 2*a*—2*a* of FIG. 1*a*.
Figure 2B:
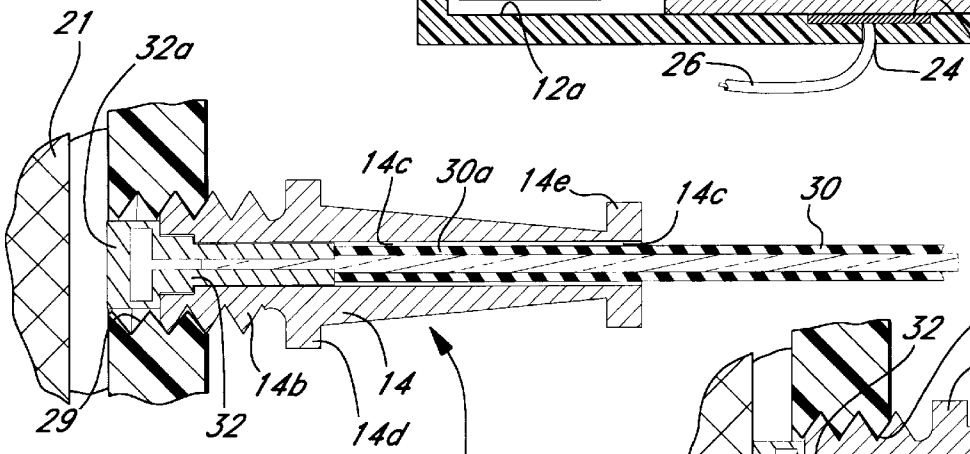
FIG. 2*b* is an enlarged, cross-sectional view of the battery case taken along line 2*b* of FIG. 2*a* with the case holding a pair of batteries and the clasp of the jewelry piece partially connected so that the jewelry piece is attached and worn, for example, around the neck of the wearer, but not engaging a battery so that there is no illumination.
Figure 2C:
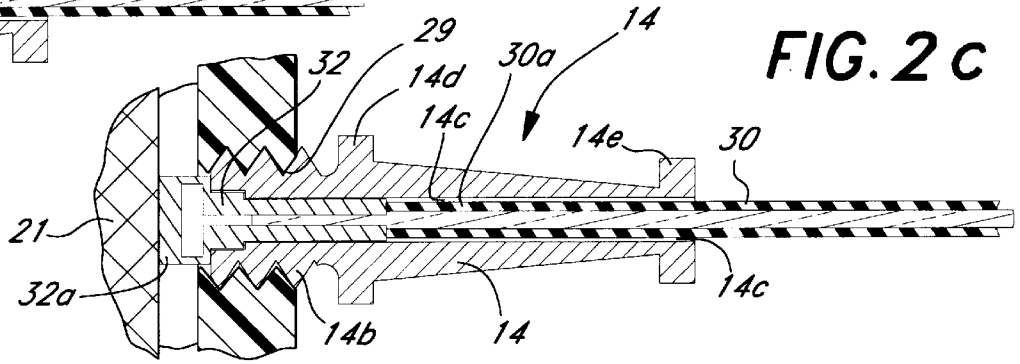
FIG. 2*c* is an enlarged, cross-sectional view similar to that shown in FIG. 2*b* with the clasp rotated to a position where a pin engages one of the batteries in the case to energize a circuit illuminating the jewelry piece.

The wire 30 extends lengthwise through the passageway 14*c* and it has at one end 30*a* a conductive collet pin 32, with an enlarged head 32*a*, securely fixed to this end of the wire 30. The other end 30*b* of the wire 30, as mentioned above, is connected to the other electrode 16*b* of the light emitting diode 16. Because of the enlarged head 32*a*, which acts as a stop, the wire 30 can not be pulled through the passageway 14*c* when move in the direction indicated by the arrow A in FIG. 1*d*. The clasp 14 is, however, free to rotate about the wire 30, allowing the threaded extension 14*b* of the clasp to be inserted into the threaded opening 29 in the sidewall 12*b* of the battery case 12 and rotated. When the threaded extension 14*b* of the clasp 14 has been only partially threaded into the opening 29 as depicted in FIG. 2*b*, the head 32*a* of the pin 32 is only partially extending into the opening and does not make contact with the positive terminal of the battery 21 inside the case 12. Consequently, the wearer may attach the jewelry piece 10, for example about his or her neck, but the ornamental crystal 20 will not be illuminated. It will only be illuminated when the clasp 14 has been completely rotated to bring the head 32*a* of the pin 32 into engagement with the positive terminal of the battery 21 as depicted in FIG. 2*c* to complete a circuit to energize the light emitting diode 16, causing it to emit light.

Figures 3, 4:
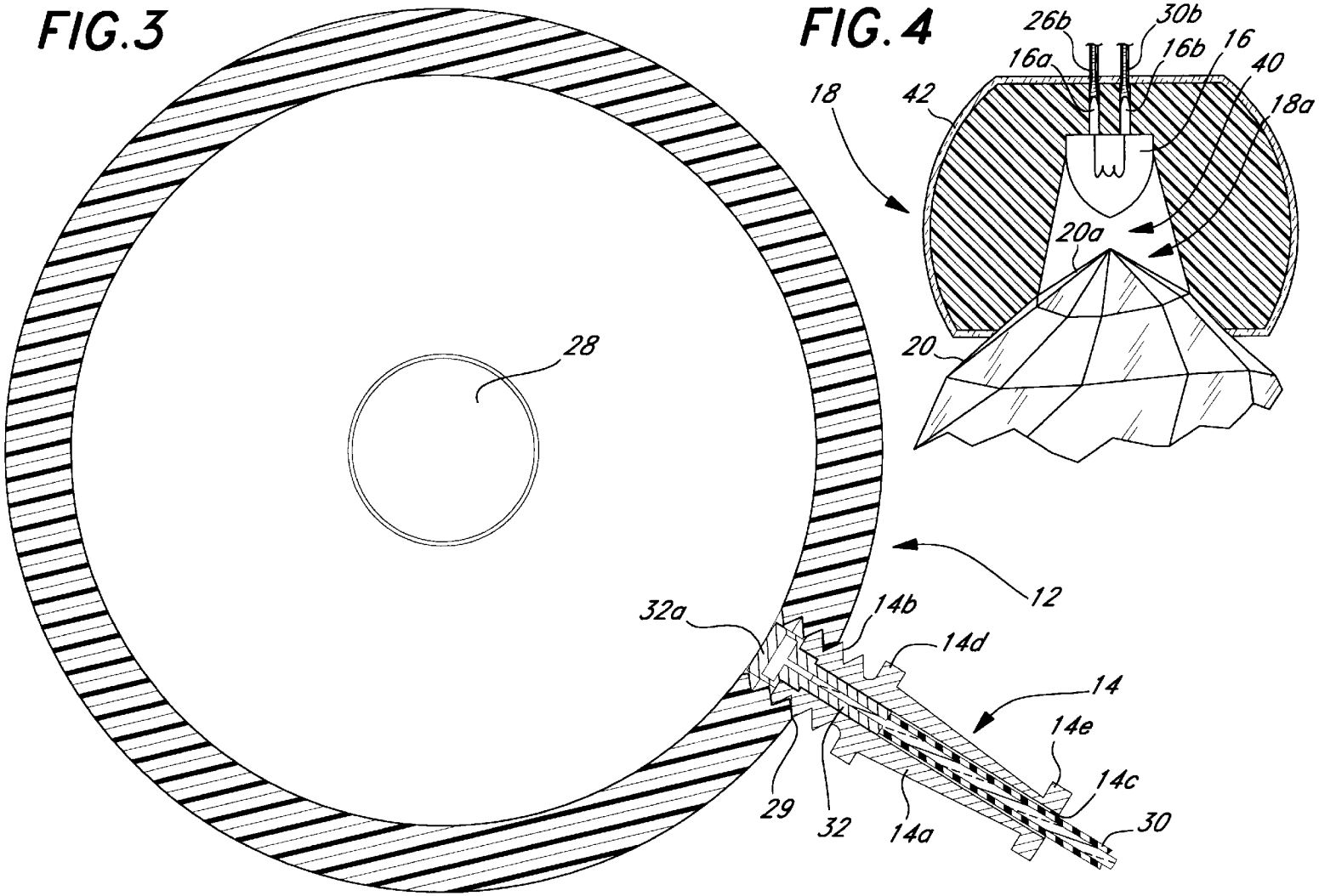
FIG. 3 is a cross sectional view of the battery case taken along line 3—3 of FIG. 1*b*, with the batteries removed to show the contact end of the other wire used to connect the batteries to the light source.
FIG. 4 is an enlarged fragmentary cross sectional view taken along line 4—4 of FIG. 1*a*, showing the light source seated within an opaque housing.

As best shown in FIG. 4, the light emitting diode 16 is seated within a cavity 40 within the housing 18 adjacent an open portion of the housing that serves as a light transmitting window 18*a*. The light emitting diode 16 is glued into position and the entire housing 18 is painted with an opaque material to provide an opaque coating 42 around the housing except for the light transmitting window 18*a*. The transparent ornamental crystal 20 has one end 20*a* adjacent this window 18*a* and is glued, or otherwise fastened, to the housing 18. Thus when the light emitting diode 16 is energized, light passes through the light transmitting window 18*a* to illuminate the transparent ornamental crystal 20 which appears to glow. To disconnect the jewelry piece 10, the clasp 14 is simply rotated in the opposite direction, for example, counter clockwise as viewed in FIG. 1*a* to loosen the clasp, allowing the pin 32 to be removed from the opening 29 in the battery case so that the wearer can remove the jewelry piece.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A jewelry piece adapted to be used with a battery, including a light transparent, ornamental element;

a light source having a pair of electrodes;

a battery case adapted to removably hold a battery, said battery cave having a threaded opening therein;

a clasp having a body with a threaded open end, a passageway extending through the body between said threaded end and another end, said threaded end of the clasp being adapted to be received in the threaded opening in the battery case;

an opaque housing having a cavity in which is seated the light source, said housing having only a single light transmitting window which allows light from the light source to be transmitted outward from said cavity; and a circuit adapted to be electrically energized when a battery is in said battery case, said circuit comprising a conductive pin having an enlarged head, first and second flexible, conductive wire elements, the first wire element having one end connected to the conductive pin and another end connected to one of the electrodes of the light source, said first wire element extending through the passageway with the enlarged head acting as a stop to prevent the pin from moving in a first direction through the passageway, the second wire element having one end connected to the battery case in a manner that places a battery into electrical contact with said one end of the second wire element upon placing a battery in the case and another end connected to the other electrode of the light source;

said light transparent, ornamental element being connected to the housing adjacent the light transmitting window so that, with the threaded end of the clasp removed from the threaded opening in the battery case, the jewelry piece is opened for attachment and detachment, and with the threaded end of the clasp received in the threaded opening in the battery case, and in a first position where the threaded end of the clasp is partially threaded into the threaded opening in the battery case such that the pin would not make contact with a battery in the case, the circuit is not energized, and in a second position where the threaded end of the clasp is further threaded into the threaded opening in the battery case such that the pin would contact a battery in the case, the circuit is energized and light from the light source emanates from the window and enters the ornamental element, illuminating said ornamental element.

2. The jewelry piece of claim 1 where the light source is a light emitting diode.

3. A jewelry piece adapted to be used with a battery having first and second terminals, including a battery case having a threaded opening therein adapted to provide access to a first terminal of the battery upon the battery being placed in the case;

a light transparent, ornamental element;

a light source mounted adjacent to the ornamental element and connected in a circuit for powering by a battery, said battery being adapted to be retained in the case;

a clasp having a body with a threaded open end and a passageway extending through the body between said threaded end and another end, said threaded open end of the clasp being adapted to be received in the threaded opening in the battery case;

a first conductive wire having one end adapted to be connected to a second terminal of the battery and another end connected to the light source; and a second conductive wire extending through the passageway in the clasp having one end connected to the light source and another end which, when partially inserted into the opening in the case, completes a loop but would not contact the first terminal of the battery when said battery has been placed in the battery case, preventing the light source from being energized, and, when completely inserted into the opening, would make contact with the first terminal of the battery when said battery has been placed in the battery case to energize the light source.

4. The jewelry piece of claim 3 including an opaque housing in which is seated the light source, said housing having only a single light transmitting window which allows light from the light source to be transmitted outward.

5. The jewelry piece of claim 3 where the second wire terminates in a conductive pin which passes through the clasp.

6. The jewelry piece of claim 5 where the clasp may be manually rotated relative to the pin.

7. The jewelry piece of claim 3 where the light source is a light emitting diode.

8. A jewelry piece adapted to be used with a battery having a pair of terminals, including a light transparent, ornamental element;

a light emitting diode having a pair of electrodes;

a compact battery case made of an insulating material and having an open top covered by a removable cover, a floor with an opening therein providing access to one terminal of a battery held within the battery case, and a side wall having a threaded opening therein providing access to another terminal of a battery being held within the battery case;

a clasp having a body through which extends a passageway, said body terminating in an outwardly projecting threaded element having a threaded end adapted to be received in the threaded opening in the side wall of the battery case, said passageway extending through said outwardly projecting threaded element;

a circuit adapted to be electrically energized by a battery in said battery case, said circuit comprising a conductive pin having an enlarged head, first and second flexible, conductive wire elements, the first wire element having one end connected to the conductive pin and another end connected to one of the electrodes of the light emitting diode, said first wire element extending through the passageway with the enlarged head acting as a stop to prevent the pin from moving in a first direction through the passageway, the second wire element having one end extending through the opening in the floor of the battery case and positioned within the case for making electrical contact with the one terminal of a battery in the case and another end connected to the other electrode of the light emitting diode;

said light transparent, ornamental element being mounted adjacent the light emitting diode so that, with the threaded end of the outwardly projecting threaded element removed from the threaded opening in the battery case, the jewelry piece is opened for detachment, and with the threaded end of the outwardly projecting threaded element received in the threaded opening in the battery case, and in a first position where the pin would not make contact with the other terminal of a battery in the case, the circuit is not energized, and in a second position where the pin would contact the other terminal of a battery in the case, the circuit is energized and light from the light emitting diode enters the ornamental element, illuminating said ornamental element.

9. The jewelry piece of claim 8 including an opaque housing having a cavity in which is seated the light emitting diode, said housing having only a single light transmitting window which allows light from the light emitting diode to be transmitted outward from said cavity.

10. The jewelry piece of claim 8 where the clasp may be manually rotated relative to the pin.

* * * * *